US007977021B2

(12) United States Patent
Fujita et al.

(10) Patent No.: US 7,977,021 B2
(45) Date of Patent: Jul. 12, 2011

(54) ELECTROPHOTOGRAPHIC TONER, AND IMAGE FORMING METHOD AND IMAGE FORMING APPARATUS EMPLOYING THE SAME

(75) Inventors: Toshiyuki Fujita, Tokyo (JP); Hirofumi Hayata, Tokyo (JP); Masahiko Kurachi, Tokyo (JP); Kunihiro Ogura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 697 days.

(21) Appl. No.: 12/047,380

(22) Filed: Mar. 13, 2008

(65) Prior Publication Data

US 2008/0318147 A1 Dec. 25, 2008

(30) Foreign Application Priority Data

Jun. 22, 2007 (JP) ..... 2007-164806

(51) Int. Cl.
*G03G 15/04* (2006.01)

(52) U.S. Cl. ..... 430/66; 430/97; 430/132

(58) Field of Classification Search ..... 430/66, 430/97, 132
See application file for complete search history.

(56) References Cited

U.S. PATENT DOCUMENTS

| | | | | |
|---|---|---|---|---|
| 3,801,536 | A * | 4/1974 | Guenantin | 523/207 |
| 5,391,449 | A * | 2/1995 | Maruyama et al. | 430/66 |
| 2007/0048013 | A1 * | 3/2007 | Tokutake et al. | 399/159 |

* cited by examiner

*Primary Examiner* — Thorl Chea
(74) *Attorney, Agent, or Firm* — Lucas & Mercanti, LLP

(57) ABSTRACT

An objective is to provide an electrophotographic photoreceptor having a protective layer in which no unevenness is generated in a coated layer even though a coating solution containing a large addition amount of metal oxide is coated, mechanical strength of a protective layer is high; productivity is high with long life of the coating solution because of no sedimentation of metal oxide, electrical resistivity and mechanical strength are satisfactory, and metal oxide generating no coated layer defect together with no light scattering caused by dispersion failure is dispersed, and also to provide an image forming method and an image forming apparatus employing the electrophotographic photoreceptor. Also disclosed is an electrophotographic photoreceptor possessing a conductive support, at least a photosensitive layer and a protective layer, wherein the protective layer comprises rutile type titanium dioxide and anatase type titanium dioxide.

11 Claims, 3 Drawing Sheets

ELECTROPHOTOGRAPHIC TONER, AND IMAGE FORMING METHOD AND IMAGE FORMING APPARATUS EMPLOYING THE SAME

TECHNICAL FIELD

The present invention relates to an electrophotographic photoreceptor, and an image forming method and an image forming apparatus employing the same.

BACKGROUND

In the past, a thermoplastic resin has caused insufficient transferability at high temperature and high humidity, and tended to generate uneven gray scale images such as a halftone and so forth, caused by scratches generated in an electrophotographic photoreceptor. In order to solve this problem, a protective layer is provided on the electrophotographic photoreceptor, and studies on the layer surface hardness of the electrophotographic photoreceptor increased and strengthened via crosslinking reaction have been done (refer to Patent document 1, for example).

The electrical resistivity of this protective layer in which metal oxide is dispersed is tried to be controlled, and a suitable volume resistance of $1\times10^{9}$-$1\times10^{15}$ Ω·cm has been disclosed (refer to Patent document 2, for example).

However, there was a problem such that unevenness of a coated layer was generated when a coating solution into which a large amount of metal oxide was added was coated to control electrical resistivity with the electrical resistivity of the protective layer depending on the addition amount of metal oxide. There was also a problem such that mechanical strength of the protective layer was lowered when the addition amount of metal oxide was reduced. Further, there was another problem such that the metal oxide shortened life of the coating solution via its sedimentation in the case of insufficient dispersibility of the metal oxide, resulting in a decline of productivity, and incident light scattering caused by dispersed particles was produced during formation of the coated layer. Thus, the protective layer in which metal oxide is dispersed produces a problem such that electrical resistivity and mechanical strength are satisfactory, but defects of the coated layer caused by dispersion failure, and light scattering are generated. No method to totally satisfy the foregoing has not yet been found in the current situation.

(Patent Document 1) Japanese Patent O.P.I. Publication No. 10-312139

(Patent Document 2) Japanese Patent O.P.I. Publication No. 11-202530

SUMMARY

The present invention was made in order to solve a problem produced at a time when electrical resistivity of the above-described protective layer is controlled with an addition amount of metal oxide.

That is, it is an object of the present invention to provide an electrophotographic photoreceptor having a protective layer in which no unevenness is generated in a coated layer even though a coating solution containing a large amount of metal oxide is coated; mechanical strength of a protective layer is high; productivity is high with long life of the coating solution because of no sedimentation of metal oxide; electrical resistivity and mechanical strength are satisfactory; and metal oxide generating no coated layer defect together with no light scattering caused by dispersion failure is dispersed, and also to provide an image forming method and an image forming apparatus employing the electrophotographic photoreceptor. Also disclosed is an electrophotographic photoreceptor possessing a conductive support, a photosensitive layer and a protective layer, wherein the protective layer comprises rutile type titanium dioxide and anatase type titanium dioxide.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DETAILED DESCRIPTION OF THE INVENTION

Figure 1:
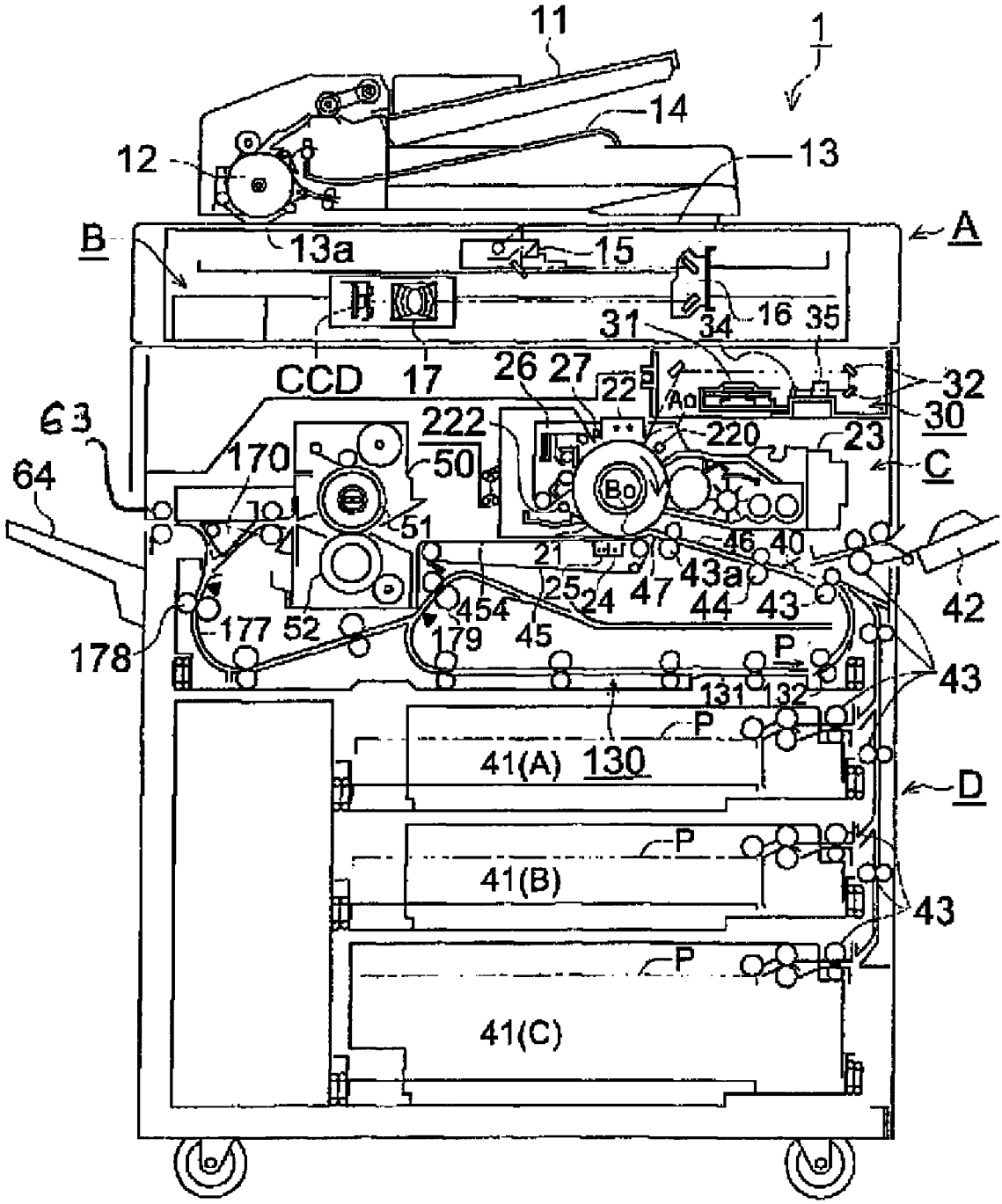
FIG. 1 is a cross-sectional schematic diagram showing an example of an image forming apparatus fitted with the photoreceptor of the present invention.

After considerable effort during intensive studies on a process of forming a coated layer exhibiting high wear resistance together with no coating defect to appropriately control electrical resistivity of a protective layer, the inventors have found out that a protective layer exhibiting high wear resistance accompanied with excellent coatability and electrical resistivity control can be prepared by containing rutile type titanium dioxide and anatase type titanium dioxide in a protective layer coating solution.

The surface resistance was previously possible to be controlled by dispersing metal oxide in the protective layer, but dispersibility of metal oxide and layer quality were largely deteriorated. However, it became possible to supply an electrophotographic photoreceptor protective layer exhibiting electrical unevenness by which the dispersibility was improved with adjustment of electrical resistivity to an appropriate value by dispersing the rutile type titanium dioxide and the anatase type titanium dioxide in the protective layer coating solution.

Further, it became possible that a toner image formed on an electrophotographic photoreceptor was transferred onto a primary transfer body with high efficiency. The reason remains clearly unsolved at the present stage, but presumably, the reason is that electric field intensity is evenly applied to each toner since the protective layer exhibits almost no electrical unevenness.

The dispersibility was further improved, and the curing reaction rate was increased by specifically dispersing the titanium dioxide and a curing compound, whereby productivity was also improved.

[Anatase Type Titanium Dioxide and Rutile Type Titanium Dioxide]

Titanium dioxide is in the crystal form of an anatase type, a rutile type or a brookite type, but almost no brookite type titanium dioxide is practically available. Of these crystal forms, the most stable crystal is the rutile type, and the anatase type is transformed into the rutile type at 915±15° C. and the brookite type is transformed into the rutile type at not less than 650° C. in the case of no presence of a transformation inhibitor or accelerator. These crystal systems can be identified via the intrinsic X-ray diffraction image of each of the crystals by a powder X-ray diffraction method.

Two different crystals called anatase and rutile exhibit different matter properties such as specific gravity, dielectric constant, hardness and so forth. Not only wear resistance of the protective layer is increased, but also resistivity can be adjusted to an appropriate value by controlling the addition amount of the titanium dioxide. As to dispersion stability, it is provided as a factor that particles are difficult to be coagulated with each other since each metal oxide has a different crystal structure despite the identical metal oxide. Improving of transferability is presumably attributed to the fact that the physical adhesive force to toner is reduced, since the surface property and roughness shape of the protective layer vary in comparison to the system in which only one kind of metal oxide is introduced.

Further, titanium dioxide of the present invention is possible to be prepared by a commonly known technique such as a vapor phase method, a chlorine method, a sulfuric method or a plasma method. Each of rutile type titanium dioxide, anatase type titanium dioxide, and the entire titanium dioxide of the rutile type titanium dioxide and the anatase type titanium dioxide was weighed to determine the mixture ratio. The rutile type titanium dioxide preferably has a content of 5-70% by weight, and more preferably has a content of 10-40% by weight, based on the total weight of the rutile type titanium dioxide and the anatase type titanium dioxide. In the case of a small amount of the rutile type titanium dioxide, mechanical strength tends to be lowered, and on the other hand, in the case of a large amount of the rutile type titanium dioxide, coagulation is easily generated, whereby defects of a coated layer tend to be produced.

The rutile type titanium dioxide or anatase type titanium dioxide of the present invention preferably has a number average primary particle diameter of 10-100 nm. In the case of a small particle diameter, insufficient wear resistance tends to be disclosed, and on the other hand, in the case of a large particle diameter, writing light is scattered and particles inhibit light curing, whereby insufficient wear resistance tends also to be disclosed.

In addition, as a method to detect an amount of titanium dioxide from a photoreceptor, the amount is weighed after the extraction from a protective layer to calculate a ratio of anatase to rutile via X-ray diffraction analysis. The ratio of anatase to rutile can be determined by the following equation. The anatase ratio is determined in powder X-ray diffraction of titanium dioxide by using the following equation after measuring intensity IA of the strongest diffraction line of anatase (face index of 101) and intensity IR of the strongest diffraction line of rutile (face index of 110).

$$\text{Anatase ratio (\%)}=100/(1+1.265\times IR/IA)$$

[Curing Compound]

The protective layer preferably contains a resin in which a curing compound is reactively cured.

The curing compound of the present invention means a compound containing a curable functional group.

The curing compound of the present invention is preferably a monomer used commonly as a binder resin for a photoreceptor such as polystyrene, polyacrylate or such via polymerization (curing) upon exposure to actinic radiation such as UV radiation, electron beams or such, and specifically, preferable examples thereof include a styrene based monomer, an acrylic monomer, a methacrylic monomer, a vinyl toluene based monomer, a vinyl acetate based monomer and N-vinyl pyrrolidone based monomer.

Among them, a compound containing an acryloyl group or a methacryloyl group is specifically preferable in view of curability in a short period of time, or with a small amount of light.

In the present invention, these monomers may be used singly or may also be used in mixture.

Typical examples of the compounds having the following structure can be exemplified.

| No. | Structural formula | The number or reactive acryloyl or methacryloyl groups |
|---|---|---|
| 1 | 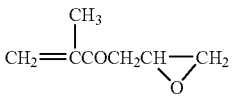 | 1 |
| 2 | 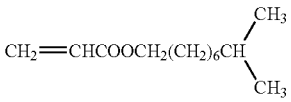 | 1 |
| 3 | $CH_2{=}CHCOO(CH_2)_6OCOCH{=}CH_2$ | 2 |
| 4 | 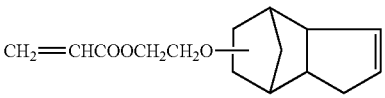 | 1 |
| 5 | 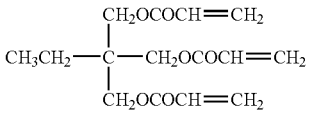 | 3 |
| 6 | 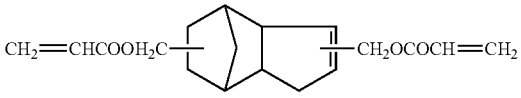 | 2 |

-continued

| No. | Structural formula | The number or reactive acryloyl or methacryloyl groups |
|---|---|---|
| 7 | $CH_2{=}CHCOOCH_2{-}C(CH_3)_2{-}CH(O{-}CH_2{-}C(C_2H_5)(CH_2OCOCH{=}CH_2){-}CH_2{-}O)$ | 2 |
| 8 | $CH_2{=}CHCO{-}(OCH_2CH_2)_4{-}O{-}C_6H_5$ | 1 |
| 9 | $CH_2{=}CHCOOCH_2{-}C(CH_2OCOCH{=}CH_2)_3$ | 4 |
| 10 | $CH_2{=}CHCOOCH_2CH(OH)CH_2O(CH_2)_6OCH_2CH(OH)CH_2OCOCH{=}CH_2$ | 2 |
| 11 | $CH_2{=}C(CH_3)COOCH_2{-}C(CH_2OCOC(CH_3){=}CH_2)_3$ | 4 |
| 12 | 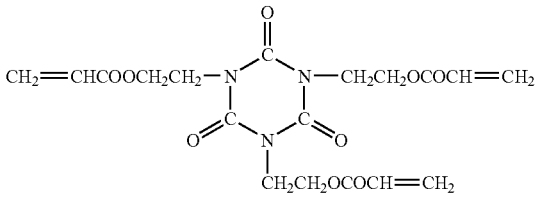 | 3 |
| 13 | 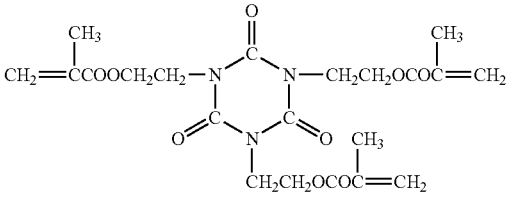 | 3 |
| 14 | $C_2H_5{-}C(CH_2OCOCH{=}CH_2)_2{-}CH_2{-}O{-}CH_2{-}C(CH_2OCOCH{=}CH_2)_2{-}C_2H_5$ | 4 |
| 15 | $CH_2OCH_2CH(OH)CH_2OCOCH{=}CH_2$<br>$CHOCH_2CH(OH)CH_2OCOCH{=}CH_2$<br>$CH_2OCH_2CH(OH)CH_2OCOCH{=}CH_2$ | 3 |
| 16 | $CH_2{=}CHCO{-}(OCH_2CH_2)_n{-}O{-}C_6H_4{-}CH_2{-}C_6H_4{-}*$<br>$*{-}O{-}(CH_2CH_2O)_m{-}COCH{=}CH_2$ m + n = 4 | 2 |

-continued

| No. | Structural formula | The number or reactive acryloyl or methacryloyl groups |
|---|---|---|
| 17 | $CH_2{=}C(CH_3)CO{-}(OCH_2CH_2)_9{-}OCH_3$ | 1 |
| 18 | $CH_3CH_2{-}C(CH_2OCH_2CH(OH)CH_2OCOCH{=}CH_2)_3$ | 3 |
| 19 | $CH_2{=}CHCOOCH_2{-}C(CH_2OCOCH{=}CH_2)_3{-}CH_2OCH_2{-}C(CH_2OCOCH{=}CH_2)_3{-}CH_2OH$ | 5 |
| 20 | 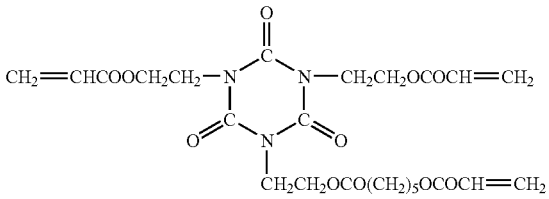 | 3 |
| 21 | 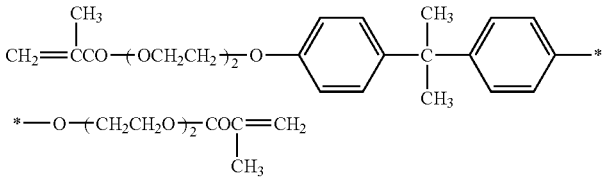 | 2 |

TMPTA (trimethylolpropane triacrylate) produced by Toagosei Co., Ltd., PMMA(Poly(methyl methacrylate)) produced by Toagosei Co., Ltd. and so forth are also provided as the curing compound.

[Polymerization Initiator]

It is preferable that a curing compound of the present invention is reactively cured in the presence of a polymerization initiator. Examples of the polymerization initiator include acetophenone based or ketal based photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morphlinophenyl) butanone-1,2-hydroxy-2-methyl-1-phenylpropane-1-one, 2-methyl-2-morpholino(4-methylthiophenyl)propane-1-one, or 1-phenyl-1,2-propanedione-2-(o-ethoxycarbonyl) oxime; benzoinether based photopolymerization initiators such as benzoin, benzoin methyl ether, benzoin isobutyl ether, or benzoin isopropyl ether; benzophenone based photopolymerization initiators such as benzophenone, 4-hydroxybenzophenone, methyl o-benzoyl benzoate, 2-benzoylnaphthalene, 4-benzoylbiphenyl, 4-benzoyl phenyl ether, acrylated benzophenone, or 1,4-benzoylbenzene; and thioxanthone based photopolymerization initiators such as 2-isopropylthioxanthone, 2-chlorothioxanthone, 2,4-dimethylthioxanthone, 2,4-diethylthioxanthone, or 2,4-dichlorothioxanthone.

Examples of other photopolymerization initiators include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenyl glyoxyester, 9,10-phenantholene, acridine based compounds, triazine based compounds, and imidazole based compounds. Further, compounds which exhibit photopolymerization enhancing effects may be employed individually or in combination with the above photopolymerization initiators. Examples of such include triethanolamine, methyldiethanolamine, ethyl 4-dimethylaminobenzoate, isoamyl 4-dimethylaminobenzoate, (2-dimethylamino)ethyl benzoate, and 4,4'-dimethylaminobenzophenone.

These polymerization initiators may be employed singly or in combination of at least two kinds. The polymerization initiator has a content of 0.5-40 parts by weight, based on 100 parts by weight of the total containing material exhibiting radical polymerization, and preferably 1-20 parts by weight.

[Curing Reaction of Curing Compound]

In the present invention, a curing compound in the presence of a polymerization initiator is exposed to actinic radiation to generate radicals for polymerization, and curing is conducted by forming crosslinking bonds via inter- and intramolecular crosslinking reaction to produce a cured resin. UV radiation and electron beams are preferred as the actinic radiation.

Usable UV radiation sources are not specifically limited as long as they generate appropriate UV radiation. Examples thereof include a low pressure mercury lamp, a medium pressure mercury lamp, a high pressure mercury lamp, an ultra-high pressure mercury lamp, a carbon arc lamp, a metal halide lamp and a xenon lamp. Exposure conditions differ depending on each of the lamps. The exposure amount of actinic radiation is 5-500 mJ/cm$^2$, but is preferably 5-1.00 mJ/cm$^2$.

As to the electron beam source, electron beam exposure devices are not specifically limited As an electron beam accelerator for electron beam exposure, effectively used is a curtain beam system by which high power can be obtained comparatively at low cost. The accelerating voltage during electron beam exposure is preferably 100-300 kV, and the absorption dose is preferably 0.5-10 Mrad.

The curing compound is desired to be exposed to actinic radiation during or after coating and drying. Exposure period to reach the necessary exposure amount of active radiation is preferably 0.1 seconds to about 1 minute, but more preferably 0.1 seconds~10 minutes in view of curing efficiency of a compound containing a curable functional group and the operation efficiency. The area exposed to actinic radiation has an illuminance of 50-150 mW/m$^2$.

UV radiation is more easily used than electron beams preferably as actinic radiation.

[Layer Structure of Photoreceptor]

The photoreceptor of the present invention comprises a photosensitive layer and a protective layer which are laminated on a conductive support in order, and is not particularly limited to the layer structure thereof, but the following layer structure is specifically usable.

1) A layer structure in which a charge generation layer and a charge transport layer as a photosensitive layer, and a protective layer are laminated on a conductive support in order.

2) A layer structure in which a layer as a photosensitive layer containing a charge transport material and a charge generation material, and a protective layer are laminated on a conductive support in order.

3) A layer structure in which an intermediate layer, a charge generation layer and a charge transport layer as a photosensitive layer, and a protective layer are laminated on a conductive support in order.

4) A layer structure in which an intermediate layer, a layer as a photosensitive layer containing a charge transport material and a charge generation material, and a protective layer are laminated on a conductive support in order.

The photoreceptor of the present invention may have any of the above-described layer structures, but of these, a layer structure in which an intermediate layer, a charge generation layer, a charge transport layer and a protective layer are formed on a conductive substrate is preferable

[Protective Layer]

The protective layer of the photoreceptor is a layer of the photoreceptor, brought into contact with air interface.

In order to form a protective layer, a solvent in which the above-described polymerization initiator, antioxidant, curing compound as the structural component is desired to be selected. That is, a good solvent (good-soluble solvent) is selected for the protective layer coating composition, and preferably employed as a coating solvent for the protective layer. Preferable examples of the solvent include tetrahydrofuran (THF), toluene and so forth.

(Particulate Additive)

Futile type titanium dioxide and anatase type titanium dioxide in combination, together with other particulate additives may be contained in the protective layer of the present invention.

Particulate additives of the present invention preferably have a number average primary particle diameter of 3-300 nm, and more preferably have a number average primary particle diameter of 10-200 nm.

The number average primary particle diameter means a value determined by a method in which the image of particles is magnified 10,000 times via transmission electron microscopy observation, and 100 particles randomly selected from the enlarged image are subjected to image analysis.

As the transmission electron microscope, "H-9000NAR" manufactured by Hitachi Ltd., and "JEM-200FX" manufactured by JEOL Ltd. are employed.

The observation employing the transmission electron microscope is carried out with a method conventionally applied for determination of the particle diameter. The determination is carried out, for example, by the following procedure. First, a sample for observation is prepared. The particles are sufficiently dispersed in epoxy resin curable at room temperature, embedded, and solidified to prepare a block. The resulting block is sliced by a microtome equipped with a diamond cutting edge into a slice having a thickness of 80-200 nm to prepare a sample for determination. Then, the image of a sample is magnified 10,000 times employing the transmission electron microscope (TEM) and micrographed. Then, the resulting photographic image information of 100 inorganic particles is processed by an image processing apparatus "LUZEX F" manufactured by Nicole Co., Ltd., to determine the number average primary particle diameter.

Particles having a number average primary particle diameter within the above-described range can be evenly dispersed in a coating solution. Therefore, formation of coagulated particle and large irregularity appearing on the surface can be prevented. As the result, a satisfactory toner image with no occurrence of black spots can be obtained via generation of black spots and transfer memory since a charge trap caused by the coagulated particles is formed. Further, such the particle is difficult to be precipitated in the coating solution and exhibits excellent dispersion stability of the solution.

In the present invention, added particles preferably contain at least inorganic particles and organic particles.

The ratio of inorganic particles to organic particles preferably has an inorganic particle content of 20-80% by weight, and more preferably has an inorganic particle content of 30-70% by weight.

The inorganic particles can be selected from silica particles, alumina particles and strontium titanate particles. Of these, silica particles and alumina particles are preferable.

The inorganic particles have preferably been subjected to surface treatment in view of improving of dispersibility and stabilizing of an electrophotographic property. For example, inorganic particles are added into a solution in which a reactive organosilicon compound is dissolved or suspended with respect to water or an organic solvent, and the resulting solution is stirred for a few minutes to approximately one hour. After heat-treating the solution optionally, a drying process is conducted after filtration to obtain inorganic particles whose surface is coated with an organosilicon compound. Incidentally, a reactive organosilicon compound may be added into a suspension in which inorganic particles are dispersed with respect to an organic solvent or water.

[Preparation of Photoreceptor]

A photoreceptor of the present invention can be produced by forming a layer by an immersion coating method, a circular coating amount control type coating method, or the immersion coating method and the circular coating amount control type coating method in combination, but the coating method is not limited thereto. The circular coating amount control type coating method is detailed in Japanese Patent O.P.I. Publication No. 58-189061.

Next, each of the layers and members constituting the photoreceptor of the present invention will be described.

(Conductive Support)

A conductive support of the present invention is cylindrical, and preferably has a specific resistance of $10^3$ Ωcm or less. As a specific example, an aluminum cylinder subjected to washing the surface after a cutting process.

(Intermediate Layer)

An intermediate layer is formed by drying after coating an intermediate layer coating solution formed from a binder, inorganic particles and a dispersion solvent, for example.

As the binder for the intermediate layer, a polyamide resin, a vinyl chloride resin, a vinyl acetate resin and a copolymer containing at least two repeating units of the above resin are usable. Of these resins, the polyamide resin is preferable since increase of a residual potential via repetitive use can be minimized.

In addition, the inorganic particles can be selected from silica particles, alumina particles, titanium dioxide particles strontium titanate particles and tin oxide particles.

As the solvent to prepare an intermediate coating solution, preferable is a solvent in which inorganic particles are well-dispersed, and a polyamide resin is dissolved. Specifically, alcohols having 2-4 carbon atoms such as ethanol, n-propyl alcohol, iso-propyl alcohol, n-butanol, t-butanol and sec-butanol are preferable are preferable in view of excellent solubility and coatability of the polyamide resin The above-described solvent has a content of 30-100% by weight, preferably has a content of 40-100% by weight, and more preferably has a content of 50-100% by weight, based on the weight of the entire solvent. Examples of the auxiliary solvent used in combination with the foregoing solvent, which produces preferable effects include methanol, benzyl alcohol, toluene, methylene chloride, cyclohexanone and tetrahydrofuran.

The intermediate layer preferably has a thickness of 0.2-40 μm, and more preferably has a thickness of 0.3-20 μm.

(Photosensitive Layer)

The photosensitive layer may be one having a single layer structure exhibiting charge generation and charge transport functions, but is preferably one having a separate layer structure in which charge generation layer (CGL) and charge transport layer (CTL) each exhibiting a function of the photosensitive layer are separately provided Increase in residual potential via repetitive use can be controlled to be minimized by taking the separate function layer structure, whereby other electrophotographic properties are easy to be controlled in line with the purpose. In the case of a photoreceptor for negative electrification, charge generation layer (CGL) is provided on an intermediate layer, and charge transport layer (CTL) is provided thereon. In the case of a photoreceptor for positive electrification, the charge generation layer and the charge transport layer are arranged to be reversely placed. The preferable layer structure of the photoreceptor is of the case where a photoreceptor for negative electrification has the foregoing separate function layer structure.

Each layer of the photosensitive layer employed for a photoreceptor for negative electrification having the separate function layer structure will be described below.

<Charge Generation Layer>

The charge generation layer contains charge generation material (CGM) A binder resin and additives as other materials may optionally be contained in the charge generation layer.

As charge generation material (CGM), commonly known charge generation material (CGM) is usable. Usable examples thereof include a phthalocyanine pigment, an azo pigment, a perylene pigment and an azulenium pigment. Among them, charge generation material (CGM) with which increase of residual potential via repetitive use can be minimized is one having a steric potential structure capable of forming a stable coagulated structure among a plurality of molecules. Specifically, phthalocyanine pigment and perylene pigment (CGM) each having a specific crystal structure can be exemplified. A titanyl phthalocyanine exhibiting the highest peak at 27.2° of Bragg angle 2θ and a benzimidazoleperylene exhibiting the highest peak at 12.4° of Bragg angle 2θ in the diffraction spectrum of Cu-Kα characteristic X-ray, for example, produce substantially no degradation via repetitive use, whereby the increase in residual potential can be minimized.

When a binder is used as a dispersing medium for CGM in a charge generation layer, commonly known binders are usable, but examples of the most preferable resin include a formal resin, a butyral resin, a silicone resin, a silicone-modified butyral resin and a phenoxy resin. The ratio of the charge generation material to the binder resin is preferably 20-600 parts by weight per 100 parts of the binder resin. The increase in residual potential via repetitive use can be minimized by using such the resin. The charge generation layer preferably has a thickness of 0.01-2 μm.

<Charge Transport Layer>

The charge transport layer contains charge transport material (CTM) and a binder resin. Additives such as an antioxidant and so forth may optionally be contained in the charge transport layer as other materials.

As charge transport material (CTM) commonly known charge transport material (CTM) is usable, and examples thereof include a triphenylamine derivative, a hydrazone compound, a styryl compound, a benizidine compound and a butadiene compound. These charge transport materials each are usually dissolved in a suitable binder resin to form a layer.

Examples of the resin employed for charge transport layer (CTL) include polystyrene, an acrylic resin, a methacrylic resin, a vinylchloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin and a copolymer resin containing at least two repeating units of the above-described resins. An organic polymer semiconductor such as poly-N-vinylcarbazole and so forth, other than insulating resins of these is applicable.

The polycarbonate resin is most preferable as a binder for CTL. The polycarbonate resin is most preferable in view of excellent dispersibility of CTM and an excellent electrophotographic property. The ratio of the charge transport material to the binder is preferably 10-200 parts by weight of CTM per 100 parts by weight of the binder resin. The charge transport layer preferably has a thickness of 10-40 μm.

(Protective Layer)

The protective layer contains a rutile type titanium dioxide, an anatase type titanium dioxide and a resin in which a curing compound is reactively cured, and optionally a polymerization initiator, an antioxidant and so forth. Particulate additives may also be contained as the material other than titanium dioxide.

The ratio of particles to the curing compound is preferably 5-50 parts by weight of the particulate additives per 100 parts by weight of the curing compound.

The protective layer preferably has a thickness of 0.2-10 μm, and more preferably has a thickness of 1.0-7.0 μm.

[Antioxidant]

Generation of image smearing at high temperature and high humidity can be prevented since influence from the attack of an active gas such as $NO_x$ can be lowered by applying an antioxidant for the structural layer of a photoreceptor.

The antioxidant of the present invention is a material, as a typical one, exhibiting a property to prevent or control an action of oxygen under the conditions of light, heat and discharge, with respect to an auto-oxidizing substance existing in an electrophotographic photoreceptor (hereinafter, referred to also as a photoreceptor) or on the photoreceptor surface. The following compound groups are specifically listed.

(1) Radical Chain Inhibitor
- Phenol based antioxidant
- hindered phenol based antioxidant
- Amine based antioxidant
- hindered amine based anti-oxidant
- diallyl diamine based antioxidant
- diallyl amine based antioxidant
- Hydroquinone based antioxidant (2) Peroxide Decomposer
- Sulfur based antioxidant
- Thioethers
- Phosphor based antioxidant
- Phosphites Incidentally, the hindered phenol based antioxidant (antioxidant having a hindered phenol structure) is a compound having a bulky organic group in the ortho position of an alkoxylated group of a phenolic OH group or a phenolic OH, and the hindered amine based antioxidant (antioxidant having a hindered amine structure) a compound having a bulky organic group in the neighborhood of a nitrogen atom. An example of the bulky organic group is a branched alkyl group, and for example, t-butyl is preferable.

Among the above-described antioxidants, (1) Radical chain inhibitor is preferable. Of these, an antioxidant having a hindered phenol structure or a hindered amine structure is preferable since reaction of oxygen with radical activated species generated from a polymerization initiator is prevented, whereby the generated radical activated species are contributed effectively to the reaction.

Further, those may be used in combination with at least two kinds, and for example, a hindered phenol based antioxidant in (1) and an antioxidant of thioethers in (2) may also be used in combination.

In the present invention, further preferable is one having the above-described hindered amine structure in the molecule in view of blurred image prevention and improved image quality via reduction of black spots, and as another embodiment, similarly preferable is one containing a hindered phenol structural unit and a hindered amine structural unit in the molecule in the molecule.

[Image Forming Apparatus]

Next, the image forming apparatus fitted with the photoreceptor of the present invention will be described.

FIG. 1 is a cross-sectional schematic diagram showing an example of an image forming apparatus fitted, with the photoreceptor of the present invention.

Image forming apparatus 1 shown in FIG. 1 is a digital image forming apparatus. It includes image reading section A, image processing section B, image forming section C, and transfer paper conveyance section D as a transfer paper conveyance device.

An automatic document feed device for automatically feeding documents is arranged on the top of image reading section A. The documents placed on the document platen 11 as conveyed sheet by sheet employing document conveying roller 12, and the image is read at reading position 13*a*. The document having been read is ejected onto document ejection tray 14 by document conveying roller 12.

In the meantime, the image of the document placed on plate glass 13 is read by reading operation at speed v by first mirror unit 15 having an illumination lamp constituting a scanning optical system and a first mirror, and by the movement of second mirror unit 16 having the second and third mirrors located at the V-shaped position at speed v/2 in the same direction.

The scanned images are formed on the light receiving surface of image-capturing device (CCD) as a line sensor through projection lens 17. The linear optical images formed on image-capturing device (CCD) are sequentially subjected to photoelectric conversion into electric signals (luminance signals). Then they are subjected to analog-to-digital conversion, and then to such processing as density conversion and filtering in image processing section B. After that, image data is stored in the memory.

Image forming section C as an image forming unit comprises: drum-formed photoreceptor 21 as an image carrier; charging section (charging process) 22 for charging photoreceptor 21 on the outer periphery; potential detecting device 220 for detecting the potential on the surface of the charged photoreceptor; developing section (developing process) 23; transfer/conveyance belt apparatus 45 as a transfer section (transfer process); cleaning section (cleaning process) 26 for photoreceptor 21; and PCL (pre-charge lamp) 27 as an optical discharging section (optical discharging process). These components are arranged in the order of operations. Further, reflected density detecting section 222 for measuring the reflected density of the patch image developed on photoreceptor 21 is provided downstream from developing section 23. A photoreceptor of the present invention is used as photoreceptor 21, and is driven in the clockwise direction as illustrated.

Rotating photoreceptor 21 is electrically charged uniformly by charging section 22. After that, image exposure is performed based on the image signal called up from the memory of image processing section B by the exposure optical system as image exposure section (image exposure process) 30. In the exposure optical system as image exposure section 30 (also known as writing section), the optical path is bent by reflection mirror 32 through rotating polygon mirror 31, fθ lens 34, and cylindrical lens 35, using the laser diode (not illustrated) as a light emitting source, whereby main scanning is performed. Exposure is carried out at position Ao with reference to photoreceptor 21, and an electrostatic latent image is formed by the rotation (sub-scanning) of photoreceptor 21.

In the image forming apparatus, when an electrostatic latent image is formed on the photoreceptor, a semiconductor laser or a light emitting diode can be employed as an image exposure light source. By narrowing an exposure light dot diameter in the writing main scanning direction to the range of 10-80 μm employing the above image exposure light source, and by conducting a digital exposure on a photoreceptor, it is possible to obtain an electrophotographic image having a high resolution of 400-2500 dpi (dpi: the number of dots per 25.4 cm).

The foregoing exposure light dot diameter means a length of the exposure beam along with the main scanning direction in the area where the intensity of this exposure beam corresponds to $1/e^2$ of the peak light intensity (Ld: measured at the maximum length position).

The exposure beam to be used includes the beams of the scanning optical system using the semiconductor laser and solid scanner such as an LED and the like. The distribution of the light intensity includes Gauss distribution and Lorenz distribution. The portion exceeding $1/e^2$ of each peak intensity is assumed as an exposure light dot diameter of the present invention.

The electrostatic latent image on photoreceptor 21 is subject to reverse development by developing section 23, and a visible toner image is formed on the surface of photoreceptor 21. According to the image forming method of the present invention, polymerized toner is utilized as the developer for this developing section. An electrophotographic image exhibiting excellent sharpness can be achieved when the polymerized toner having a uniform shape and particle size is used in combination with the photoreceptor of the present invention.

In transfer paper conveyance section D, sheet feed units 41(A), 41(B) and 41(C) as a transfer sheet storage device are arranged below the image forming unit, wherein transfer sheets P having different sizes are stored. A manual sheet feed unit 42 for manual feed of the sheets of paper is provided on the side. Transfer sheets P selected by either of the two are fed along sheet conveyance path 40 by guide roller 43, and are temporarily suspended by sheet feed registration roller 44 for correcting the inclination and deviation of transfer sheets P. Then transfer sheets P are again fed and guided by sheet conveyance path 40, pre-transfer roller 43*a*, paper feed path 46 and entry guide plate 47. The toner image on photoreceptor 21 is transferred to transfer sheet P at transfer position Bo by transfer electrode 24 and separator electrode 25, while being carried by transfer/conveyance belt 454 of transfer/conveyance belt apparatus 45. Transfer sheet P is separated from the surface of photoreceptor 21 by separation claw unit 250 and is brought to fixing apparatus 50 as a fixing device by transfer/conveyance belt apparatus 45.

Fixing device 50 contains fixing roller 51 and pressure roller 52. When transfer sheet P passes between fixing roller 51 and pressure roller 52, toner is fixed in position by heat and pressure. With the toner image having been fixed thereon, transfer sheet P is ejected onto ejection tray 64.

The above description indicates the case where an image is formed on one side of the transfer sheet In the case of duplex copying, ejection switching member 170 is switched and transfer sheet guide 177 is opened. Transfer sheet P is fed in the direction of an arrow showed in a broken line.

Further, transfer sheet P is fed downward by conveyance device 178 and is switched back by sheet reversing section 179. With the trailing edge of transfer sheet P becoming the leading edge, transfer sheet P is conveyed into sheet feed unit 130 for duplex copying.

Conveyance guide 131 provided on sheet feed unit 130 for duplex copying is moved in the direction of sheet feed by transfer sheet P. Then transfer sheet P is fed again by sheet feed roller 132 and is led to sheet conveyance path 40.

As described above, transfer sheet P is again fed in the direction of photoreceptor 21, and the toner image is transferred on the reverse side of transfer sheet P. After the image has been fixed by fixing section 50, transfer sheet P is ejected to ejection tray 64 through roller pair 63.

The image forming apparatus can be configured in such a way that the components such as the foregoing photoreceptor, developing section and cleaning section are integrally combined into a process cartridge, and this unit is mounted on the apparatus proper as a removable unit. It is also possible to arrange such a configuration that at least one of the charging section, image exposure device, developing section, transfer electrode, separator electrode and cleaning section is supported integrally with the photoreceptor, so as to form a process cartridge that, as a removable single unit, is mounted on the apparatus proper, employing a guide device such as a rail of the apparatus main body.

Figure 2:
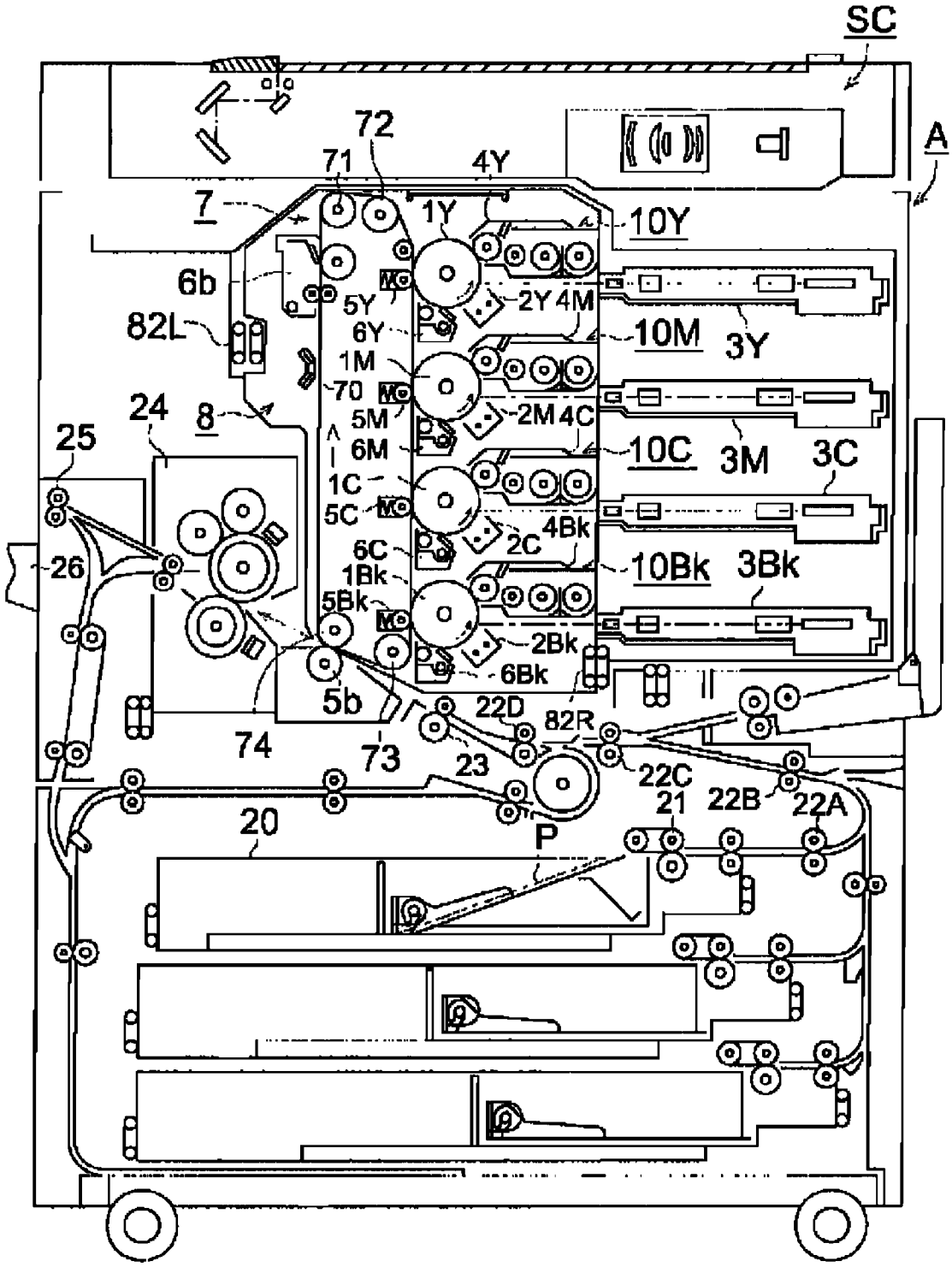
FIG. 2 is a cross-sectional schematic diagram showing an example of a color image forming apparatus fitted with the photoreceptor of the present invention.

FIG. 2 is a cross-sectional schematic diagram showing an example of a color image forming apparatus fitted with the photoreceptor of the present invention.

The color image forming apparatus shown in FIG. 2 is called the so-called tandem type color image forming apparatus, and comprises four sets of image forming sections (image forming units) 10Y, 10M, 10C, and 10Bk, endless belt shaped Intermediate image transfer body unit 7, sheet feeding and conveyance device 21, and fixing device 24. The original document reading apparatus SC is placed on top of main unit A of the image forming apparatus.

Image forming section 10Y that forms images of yellow color comprises charging device (charging process) 2Y, exposure device (exposure process) 3Y, developing device (developing process) 4Y, primary transfer roller 5Y as primary transfer section (primary transfer process), and cleaning device 6Y all placed around drum-formed photoreceptor 1Y which acts as the first image supporting body. Image forming section 10M that forms images of magenta color comprises drum-formed photoreceptor 1M which acts as the first image supporting body, charging device 2M, exposure device 3M, developing device 4M, primary transfer roller 5M as a primary transfer section, and cleaning device 6M. Image forming section 10C that forms images of cyan color comprises drum-formed photoreceptor 1C which acts as the first image supporting body, charging device 2C, exposure device 3C, developing device 4C, primary transfer roller 5C as a primary transfer section, and cleaning device 6C. Image forming section 10Bk that forms images of black color comprises drum-formed photoreceptor 1Bk which acts as the first image supporting body, charging device 2Bk, exposure device 3Bk, developing device 4Bk, primary transfer roller 5Bk as a primary transfer section, and cleaning device 6Bk.

Four sets of image forming units 10Y, 10M, 10C, and 10Bk are constituted, centering on photosensitive drums 1Y, 1M, 1C, and 1Bk, by rotating charging devices 2Y, 2M, 2C, and 2Bk, image exposure devices 3Y, 3M, 3C, and 3Bk, rotating developing devices 4Y, 4M, 4C, and 4Bk, and cleaning devices 5Y, 5M, 5C, and 5Bk that clean photosensitive drums 1Y, 1M, 1C, and 1Bk.

Image forming units 10Y, 10M, 10C, and 10Bk, all have the same configuration excepting that the color of the toner image formed in each unit is different on respective photosensitive drums 1Y, 1M, 1C, and 1Bk, and detailed description is given below taking the example of image forming unit 10Y.

Image forming unit 10Y has, placed around photosensitive drum 1Y which is the image forming body, charging device 2Y (hereinafter referred to merely as charging unit 2Y or charger 2Y), exposure device 3Y, developing device 4Y, and cleaning device 5Y (hereinafter referred to merely as cleaning device 5Y or as cleaning blade 5Y), and forms yellow (Y) colored toner image on photosensitive drum 1Y. Further, in the present preferred embodiment, at least photosensitive drum 1Y, charging device 2Y, developing device 4Y, and cleaning device 5Y in image forming unit 10Y are provided in an integral manner.

Charging device 2Y is a device that applies a uniform electrostatic potential to photosensitive drum 1Y, and corona discharge type charger unit 2Y is being used for photosensitive drum 1Y in the present preferred embodiment.

Image exposure device 3Y is a device that carries out light exposure, based on the image signal (Yellow), on photosensitive drum 1Y to which a uniform potential has been applied by charging device 2Y, and forms the electrostatic latent image corresponding to the yellow color image, and an array of light emitting devices LEDs and imaging elements (product name: SELFOC LENSES) arranged in the axial direction of photosensitive drum 1Y or a laser optical system, etc., is used as exposure device 3Y.

Intermediate image transfer body unit 7 in the shape of an endless belt is wound around a plurality of rollers, and has endless belt shaped intermediate image transfer body 70 which acts as a second image carrier in the shape of a partially conducting endless belt which is supported in a free manner to rotate The images of different colors formed by image forming units 10Y, 10M, 10C, and 10Bk, are successively transferred on to rotating endless belt shaped intermediate image transfer body 70 by primary transfer rollers 5Y, 5M, 5C, and 5Bk acting as the primary image transfer section, thereby forming the synthesized color image. Transfer material P as the transfer material stored inside sheet feeding cassette 20 (the supporting body that carries the final fixed image: for example, plain paper, transparent sheet, etc.) is fed from sheet feeding device 21, pass through a plurality or intermediate rollers 22A, 22B, 22C, and 22D, and resist roller 23, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing device 24, and is gripped by sheet discharge rollers 25 and placed above sheet discharge tray 26 outside the equipment. Here, the transfer supporting body of the toner image formed on the photoreceptor of the intermediate transfer body or of the transfer material, etc. is comprehensively called the transfer media.

On the other hand, after the color image is transferred to transfer material P by secondary transfer roller 5*b* functioning as the secondary transfer section, endless belt shaped intermediate image transfer body 70 from which transfer material P has been separated due to different radii of curvature is cleaned by cleaning device 6*b* to remove all residual toner on it.

During image forming, primary transfer roller 5Bk is at all times contacting against photoreceptor 1Bk. Other primary transfer rollers 5Y, 5M, and 5C come into contact respectively with corresponding photoreceptors 1Y, 1M, and 1C only during color image forming.

Secondary transfer roller 5*b* comes into contact with endless belt shaped intermediate transfer body 70 only when secondary transfer is conducted with transfer material P passing through this.

Further, chassis 8 can be pulled out via supporting rails 82L and 82R from body A of the apparatus.

Chassis 8 comprises image forming sections 10Y, 10M, 10C, and 10Bk, and endless belt shaped intermediate image transfer body unit 7.

Image forming sections 10Y, 10M, 10C, and 10Bk are arranged in column in the vertical direction. Endless belt shaped intermediate image transfer body unit 7 is placed to the left side in the figure of photosensitive drums 1Y, 1M, 1C, and 1Bk. Endless belt shaped intermediate image transfer body unit 70 comprises endless belt shaped intermediate image transfer body 70 that can rotate around rollers 71, 72, 73, and 74, primary image transfer rollers 5Y, 5M, 5C, and 5Bk, and cleaning device 6*b*.

Figure 3:
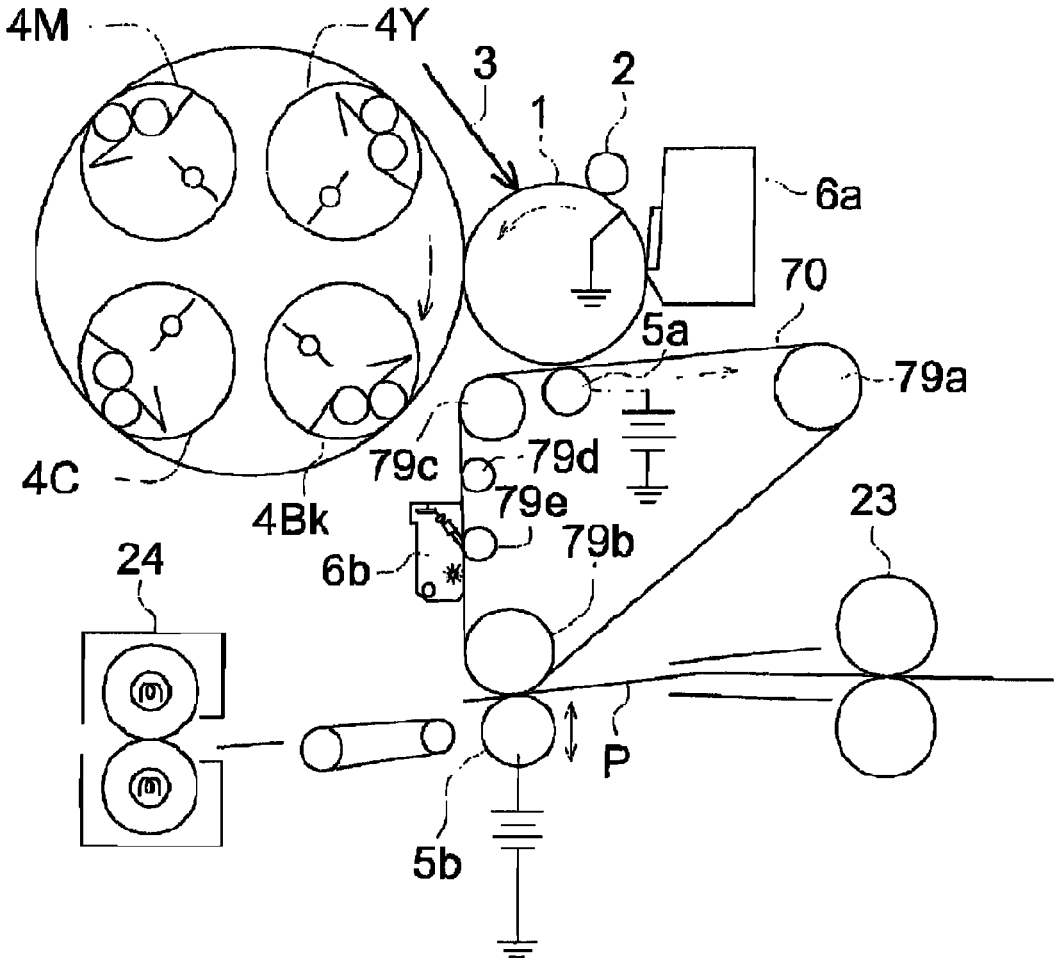
FIG. 3 is a cross-sectional schematic diagram showing another example of a color image forming apparatus fitted with a photoreceptor of the present invention.

FIG. 3 is a cross-sectional schematic diagram showing another example of a color image forming apparatus fitted with a photoreceptor of the present invention.

The color image forming apparatus of FIG. 3 shows a cross-sectional configuration diagram of a laser beam printer comprising a charging device, an exposure device, a plurality of developing devices, an image transfer device, a cleaning device, and an intermediate image transfer body around the photoreceptor, and an elastic material with a medium level of electrical resistivity is employed for belt shaped intermediate image transfer body 70.

In FIG. 3, numeral 1 is a rotating drum type photoreceptor that is used repetitively as the image carrying body, and is driven to rotate with a specific circumferential velocity in the anti-clockwise direction shown by the arrow.

During rotation, photoreceptor 1 is charged uniformly to a specific polarity and potential by charging device (charging process) 2, after which it receives from image exposure device (image exposure process) 3 not shown in the figure image exposure by the scanning exposure light from a laser beam modulated according to the time-serial electrical digital pixel signal of the image information thereby forming the electrostatic latent image corresponding to yellow (Y) color component (color information) of the target color image.

Next, this electrostatic latent image is developed by yellow (Y) developing device: developing process (yellow color developer) 4Y using the yellow toner which is the first color. At this time, the second developing device to the fourth developing device (magenta color developer, cyan color developer, and black color developer) 4M, 4C, and 4Bk are each in the operation switched-off state and do not act on photoreceptor 1, and the yellow toner image of the above first color does not get affected by the above-described second developing device to fourth developing device.

Intermediate image transfer body 70 is wound over rollers 79*a*, 79*b*, 79*c*, 79*d*, and 79*e* and is driven to rotate in a clockwise direction with the same circumferential speed as photoreceptor 1.

The yellow toner image of the first color formed and retained on photoreceptor 1 is, in the process of passing through the nip section between photoreceptor 1 and intermediate image transfer body 70, intermediate transferred (primary transferred) successively to the outer peripheral surface of intermediate image transfer body 70 due to the electric field formed by the primary transfer bias voltage applied from primary transfer roller 5*a* to intermediate image transfer body 70.

The surface of photoreceptor 1 after it has completed the transfer of the first color yellow toner image to intermediate image transfer body 70 is cleaned by cleaning section 6*a*.

In the same manner as described above, the second color magenta toner image, the third color cyan toner image, and the fourth color black toner image are transferred successively on to intermediate image transfer body 70 in a superimposing manner, thereby forming the superimposed color toner image corresponding to the desired color image.

Secondary transfer roller 5*b* is placed so that it is supported by bearings parallel to secondary transfer opposing roller 79*b* and pushes against intermediate image transfer body 70 from below in a separable condition.

In order to carry out successive overlapping transfer of the toner images of the first to fourth colors from photoreceptor 1 to intermediate image transfer body 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from photoreceptor 1 to intermediate image transfer body 70, secondary transfer roller 5*b* and intermediate image transfer body cleaning device 6*b* can be separated from intermediate image transfer body 70.

The transfer of the superimposed color toner image transferred on to belt shaped intermediate image transfer body 70 on to transfer material P which is the second image supporting body is done when secondary transfer roller 5*b* is in contact with the belt of intermediate image transfer body 70, and transfer material P is fed from corresponding sheet feeding resist roller 23 via the transfer sheet guide to the contacting nip between secondary transfer roller 5*b* and intermediate image transfer body 70 at a specific timing. The secondary transfer bias voltage is applied from the bias power supply to secondary image transfer roller 5*b*. Because of this secondary transfer bias voltage, the superimposed color toner image is transferred (secondary transfer) from intermediate image transfer body 70 to transfer material P which is the second image supporting body. Transfer material P which has received the transfer of the toner image is guided to fixing device 24 and is heated and fixed there.

EXAMPLE

Next, the present invention will now be described in detail referring to examples, but the present invention is not limited thereto. Incidentally, "part" in the description represents "part by weight".

<Preparation of Photoreceptor 1>

Photoreceptor 1 was prepared as described below.

The surface of cylinder type aluminum support having a diameter of 30 mm and a length of 346 mm was subjected to cutting processing to prepare a conductive support having a surface roughness Rz of 1.5 μm.

<Intermediate Layer>

A dispersion solution having the following composition was diluted twice with the same mixture solvent, and filtered after standing for overnight (filter; NihonPall Ltd. RIGIMESH 5 μm filter, produced by Nihon Pall Ltd.), to prepare an intermediate layer coating solution

| | |
|---|---|
| Polyamide resin CM8000 (produced by Toray Industries, Inc.) | 1 part |
| Titanium dioxide SMT500SAS (produced by Tayca Corporation) | 3 parts |
| Methanol | 10 parts |

Dispersing was conducted for 10 hours employing a batch type sand mill as a homogenizer.

The resulting coating solution was coated on the foregoing support by a dip coating method so as to give a dry thickness of 2 μm.

<Charge Generation Layer>

| | |
|---|---|
| Charge generation material: Titanylphthalocyanine Pigment (titanylphthalocyanine pigment having the maximum diffraction peak at a Bragg angle 2θ of at least 27.3° measured by X-ray diffraction spectrum with Cu-Kα characteristic X-rays) | 20 parts |
| Polyvinyl butyral resin (#6000-C, produced by DENKI KAGAKU KOGYO KABUSHIKI KAISHA) | 10 parts |
| Acetic acid t-butyl | 700 parts |
| 4-methoxy-4-methyl-2-pentanone | 300 parts |

The above-described components were mixed, and dispersed for 10 hours employing a sand mill to prepare a charge generation layer coating solution. This coating solution was coated on the foregoing intermediate layer by a dip coating method to form a charge generation layer having a dry thickness of 0.3 μm.

| | |
|---|---|
| Charge transport material: 4,4'-dimethyl-4''-(β-phenyl styryl) triphenylamine | 225 parts |
| Binder: Polycarbonate (Z300, produced by Mitsubishi Gas Chemicals, Inc.) | 300 parts |
| Antioxidant (Irganox1010, produced by Nihon Ciba-geigy Co., Ltd.) | 6 parts |
| Dichloromethane | 2000 parts |
| Silicone oil (KF-54, produced by Shin-Etsu Chemical Co., Ltd.) | 1 Part |

The above-described components were mixed and dissolved to prepare a charge transport layer coating solution. This coating solution was coated on the foregoing charge generation layer employing a circular slide hopper coater to form a charge transport layer having a dry thickness of 20 μm.

<Protective Layer>

| | |
|---|---|
| Anatase type titanium dioxide (an average primary particle diameter of 10 nm) | 8 parts |
| Rutile type titanium dioxide (an average primary particle diameter of 10 nm) | 2 parts |
| Curing compound (Exemplified compound No. 5) | 20 parts |
| Polymerization initiator: 1-hydroxycyclohexyl(phenyl)methanone | 1 part |
| Tetrahydrofuran (THF) | 10 parts |
| Isopropyl alcohol | 40 parts |

The above-described components were mixed while stirring, and sufficiently dissolved and dispersed to prepare a protective layer coating solution. This coating solution was coated on a photosensitive layer produced up to the previously prepared charge transport layer employing a circular slide hopper coater to form a protective layer. After conducting a drying process at 90° C. for 20 minutes, the resulting was exposed to UV radiation of 1 W for one minute employing a low pressure mercury lamp to obtain a protective layer having a dry thickness of 5.0 μm.

<Preparation of Photoreceptor 2>

Photoreceptor 2 was prepared similarly to preparation of photoreceptor 1, except that the protective layer was replaced by one described below.

<Protective Layer>

| | |
|---|---|
| Anatase type titanium dioxide (an average primary particle diameter of 30 nm) | 10 parts |
| Curing compound (Exemplified compound No. 14) | 20 parts |
| Polymerization initiator: | |
| 1-hydroxycyclohexyl(phenyl)methanone | 1 part |
| Tetrahydrofuran (THF) | 10 parts |
| Isopropyl alcohol | 40 parts |

<Preparation of Photoreceptor 3>

Photoreceptor 3 was prepared similarly to preparation of photoreceptor 1, except that the protective layer was replaced by one described below.

<Protective Layer>

| | |
|---|---|
| Rutile type titanium dioxide (an average primary particle diameter of 10 nm) | 10 parts |
| Curing compound (Exemplified compound No. 5) | 20 parts |
| Polymerization initiator: | |
| 1-hydroxycyclohexyl(phenyl)methanone | 1 part |
| Tetrahydrofuran (THF) | 10 parts |
| Isopropyl alcohol | 40 parts |

<Preparation of Photoreceptor 4>

Photoreceptor 4 was prepared similarly to preparation of photoreceptor 1, except that the protective layer was replaced by one described below.

<Protective Layer>

| | |
|---|---|
| Anatase type titanium dioxide (an average primary particle diameter of 20 nm) | 9.7 parts |
| Rutile type titanium dioxide (an average primary particle diameter of 10 nm) | 0.3 parts |
| Curing compound (Exemplified compound No. 9) | 20 parts |
| Polymerization initiator: | |
| 1-hydroxycyclohexyl(phenyl)methanone | 1 part |
| Tetrahydrofuran (THF) | 10 parts |
| Isopropyl alcohol | 40 parts |

<Preparation of Photoreceptor 5>

Photoreceptor 5 was prepared similarly to preparation of photoreceptor 1, except that the protective layer was replaced by one described below.

<Protective Layer>

| | |
|---|---|
| Anatase type titanium dioxide (an average primary particle diameter of 10 nm) | 5 parts |
| Hexagonal zinc oxide (an average primary particle diameter of 30 nm) | 5 parts |
| Curing compound (Exemplified compound No. 9) | 20 parts |
| Polymerization initiator: | |
| 1-hydroxycyclohexyl(phenyl)methanone | 1 part |
| Tetrahydrofuran (THF) | 10 parts |
| Isopropyl alcohol | 40 parts |

<Preparation of Photoreceptor 6>

Photoreceptor 6 was prepared similarly to preparation of photoreceptor 1, except that the protective layer was replaced by one described below.

<Protective Layer>

| | |
|---|---|
| Anatase type titanium dioxide (an average primary particle diameter of 30 nm) | 9.5 parts |
| Rutile type titanium dioxide (an average primary particle diameter of 30 nm) | 0.5 parts |
| Curing compound (Exemplified compound No. 14) | 20 parts |
| Polymerization initiator: | |
| 1-hydroxycyclohexyl(phenyl)methanone | 1 part |
| Tetrahydrofuran (THF) | 10 parts |
| Isopropyl alcohol | 40 parts |

<Preparation of Photoreceptor 7>

The intermediate layer, the charge generation layer and the charge transport layer were prepared in the same manner as in the case of photoreceptor 1.

The following protective layer was formed to prepare photoreceptor 7.

<Protective Layer>

| | |
|---|---|
| Anatase type titanium dioxide (an average primary particle diameter of 40 nm) | 3 parts |
| Rutile type titanium dioxide (an average primary particle diameter of 20 nm) | 7 parts |
| Polycarbonate resin (Z300, produced by Mitsubishi Gas Chemicals, Inc.) | 20 parts |
| Tetrahydrofuran (THF) | 40 parts |
| Toluene | 10 parts |

The above-described components were mixed while stirring, and sufficiently dissolved and dispersed to prepare a protective layer coating solution. This coating solution was coated on a photosensitive layer produced up to the previously prepared charge transport layer employing a circular slide hopper coater to form a protective layer. After coating, a drying process was conducted at 120° C. for 30 minutes to obtain a protective layer having a dry thickness of 5.0 μm.

<Preparation of Photoreceptor 8>

Photoreceptor 8 was prepared similarly to preparation of photoreceptor 1, except that the protective layer was replaced by one described below.

<Protective Layer>

| | |
|---|---|
| Anatase type titanium dioxide (an average primary particle diameter of 30 nm) | 2 parts |
| Rutile type titanium dioxide (an average primary particle diameter of 30 nm) | 8 parts |
| Curing compound (Exemplified compound No. 5) | 20 parts |
| Polymerization initiator: | |
| 1-hydroxycyclohexyl(phenyl)methanone | 1 part |
| Tetrahydrofuran (THF) | 10 parts |
| Isopropyl alcohol | 40 parts |

<Preparation of Photoreceptor 9>

The intermediate layer, the charge generation layer and the charge transport layer were prepared in the same manner as in the case of photoreceptor 1.

<Protective Layer>

| | |
|---|---|
| Anatase type titanium dioxide (an average primary particle diameter of 6 nm) | 5 parts |
| Rutile type titanium dioxide (an average primary particle diameter of 6 nm) | 5 parts |
| Methyltrimethoxy silane | 12 parts |
| γ-glycidoxypropyltrimethoxy silane | 8 parts |

-continued

| | |
|---|---|
| Colloidal silica (30% methanol solution, produced by Nissan Chemical Industries, Ltd.) | 10 parts |
| Antioxidant (Irganox1010, produced by Nihon Ciba-geigy Co., Ltd.) | 1 part |
| 1-butanol | 50 parts |
| 1% of acetic acid | 3 parts |
| Trisacetylacetonato aluminum | 0.5 parts |

The above-described components were mixed while stirring, and sufficiently dissolved and dispersed to prepare a protective layer coating solution. This coating solution was coated on a photosensitive layer produced up to the previously prepared charge transport layer employing a circular slide hopper coater to form a protective layer. After coating, a heat-curing process was conducted at 110° C. for 80 minutes to obtain a protective layer having a dry thickness of 5.0 μm.

Evaluation

[Evaluation of Electrophotographic Photoreceptor]

The resulting photoreceptor was evaluated as described below.

(Film Strength)

The drum wear amount after practical photographic operation equivalent to 100,000 drum rotations was measured at 23° C. and 50% RH.

A: Less than 0.3 (Excellent)

B: At least 0.3 and less than 1 (No problem)

C: At least 1 and less than 3 (Practically applicable)

D: At least 3 (Practical problem)

(Dispersibility)

Sedimentation observed by standing for one day after being dispersed in the protective layer solution was taken as evaluation criteria of titanium dioxide dispersibility as shown below.

A: No sedimentation of titanium dioxide is observed.

B: Sedimentation of titanium dioxide is slightly observed.

C: Sedimentation of titanium dioxide is observed, but the supernatant part of the liquid is transparent.

D: Sedimentation of titanium dioxide is observed, and the entire liquid is transparent (Transfer Ratio)

The transfer ratio was obtained with BizhubC250 from a ratio of the amount of toner transferred from a photoreceptor into a transferred body to the amount of toner developed on the photoreceptor.

A transfer ratio of at least 95%: Excellent

A transfer ratio of at least 90% and less than 95%: Good

A transfer ratio of at least 80% and less than 90%: practically with no problem

A transfer ratio of less than 80%: practically with a problem

TABLE 1

| | Particle composition ratio (% by weight) | | | Binder resin | | | | | |
|---|---|---|---|---|---|---|---|---|---|
| Photoreceptor No. | Anatase type titanium dioxide | Rutile type titanium dioxide | Other particles | Property | Functional group | Dispersibility | Film Strength | Transfer ratio (%) | Remarks |
| 1 | 80 | 20 | 0 | Curing | Acryloyl group | A | A | 98 | Inv. |
| 2 | 100 | 0 | 0 | Curing | Acryloyl group | D | D | 73 | Comp. |
| 3 | 0 | 100 | 0 | Curing | Acryloyl group | D | B | 76 | Comp. |
| 4 | 97 | 3 | 0 | Curing | Acryloyl group | A | C | 89 | Inv. |
| 5 | 50 | 0 | 50 | Curing | Acryloyl group | D | D | 78 | Comp. |
| 6 | 95 | 5 | 0 | Curing | Acryloyl group | A | B | 94 | Inv. |
| 7 | 30 | 70 | 0 | Thermo-plastic | — | B | A | 94 | Inv. |
| 8 | 20 | 80 | 0 | Curing | Acryloyl group | C | A | 93 | Inv. |
| 9 | 50 | 50 | 0 | Curing | Methoxy group | B | B | 93 | Inv. |

Inv.: Present invention

Comp.: Comparative example

As is clear from Table 1, it is to be understood that any of the embodiments within the present invention exhibits excellent properties together with practical applicability, but comparative examples outside the present invention each have produced a problem in at least any of the properties

EFFECT OF THE INVENTION

The present invention is possible to provide an electrophotographic photoreceptor having a protective layer in which no unevenness is generated in a coated layer even though a coating solution containing a large addition amount of metal oxide is coated, mechanical strength of a protective layer is high, productivity is high with long life of the coating solution because of no sedimentation of metal oxide, electrical resistivity and mechanical strength are satisfactory, and metal oxide generating no coated layer defect together with no light scattering caused by dispersion failure is dispersed, and also to provide an image forming method and an image forming apparatus employing the electrophotographic photoreceptor.

What is claimed is:

1. An electrophotographic photoreceptor comprising a conductive support, a photosensitive layer and a protective layer, wherein the protective layer comprises rutile titanium dioxide and anatase titanium dioxide.

2. The electrophotographic photoreceptor of claim 1, wherein the protective layer further comprises a resin in which a curing compound is reactively cured.

3. The electrophotographic photoreceptor of claim 2, wherein the curing compound comprises an acryloyl group or a methacryloyl group.

4. The electrophotographic photoreceptor of claim 3, wherein the rutile titanium dioxide has a content of 5-70% by weight, based on the total weight of the rutile titanium dioxide and the anatase titanium dioxide contained in the protective layer.

5. The electrophotographic photoreceptor of claim 1, wherein the rutile titanium dioxide has a content of 5-70% by weight, based on the total weight of the rutile titanium dioxide and the anatase titanium dioxide contained in the protective layer.

6. The electrophotographic photoreceptor of claim 1, wherein the protective layer has a thickness of 0.2 to 10 μm.

7. The electrophotographic photoreceptor of claim 1, wherein the protective layer has a thickness of 1.0 to 7.0 μm.

8. The electrophotographic photoreceptor of claim 7, wherein the protective layer further comprises a resin formed by reacting a UV light curable compound.

9. The electrophotographic photoreceptor of claim 6, wherein the protective layer comprises an antioxidant.

10. An image forming method comprising the step of:

exposing the electrophotographic photoreceptor of claim 1 with a light to form a latent image.

11. An image forming apparatus comprising a plurality of the electrophotographic photoreceptors of claim 1 to form a color image comprising a plurality of colors.

* * * * *